United States Patent [19]

Stauffer et al.

[11] Patent Number: 5,019,110

[45] Date of Patent: May 28, 1991

[54] NEEDLE RING WITH NEEDLES FOR THE COMBING CYLINDER OF AN OPEN-END SPINNING MACHINE

[75] Inventors: Jörg Stauffer, Ettingen, Switzerland; Pierre Müller, Le Bois d'Oingt, France

[73] Assignee: Ringtex-Kolifrath S.a.r.l., Buhl, France

[21] Appl. No.: 353,638

[22] PCT Filed: Jul. 21, 1988

[86] PCT No.: PCT/CH88/00129

§ 371 Date: Mar. 30, 1989

§ 102(e) Date: Mar. 30, 1989

[87] PCT Pub. No.: WO89/01064

PCT Pub. Date: Feb. 9, 1989

[30] Foreign Application Priority Data

Aug. 3, 1987 [CH] Switzerland ..... 2967/87
Mar. 3, 1988 [CH] Switzerland ..... 807/88

[51] Int. Cl.[5] ..... D01B 1/24

[52] U.S. Cl. ..... 19/128; 19/115 R; 19/98

[58] Field of Search ..... 19/97, 128, 80 R, 80 A, 19/115

[56] References Cited

U.S. PATENT DOCUMENTS

| | | | |
|---|---|---|---|
| 304,208 | 8/1884 | Lemaire | 19/128 |
| 1,115,990 | 11/1914 | Toles | 19/128 X |
| 1,323,885 | 12/1919 | McBride | 19/128 X |
| 1,944,526 | 1/1934 | Perron | 19/97 X |
| 2,028,919 | 1/1936 | Parker | 19/97 |
| 2,261,452 | 11/1941 | Reed | 19/97 |
| 3,646,639 | 3/1972 | Burckhardt | 19/128 X |

FOREIGN PATENT DOCUMENTS

| | | |
|---|---|---|
| 0287325 | 3/1928 | United Kingdom . |
| 2109831 | 6/1983 | United Kingdom . |

OTHER PUBLICATIONS

Textilebetrieb, vol. 96, #4, Apr. 1978, "Ein Qualifiziertes Faserauflöseaggreagat für OE—Rotorspinnsysteme".

*Primary Examiner*—Werner H. Schroeder
*Assistant Examiner*—Ismael Izaguirre
*Attorney, Agent, or Firm*—Spencer & Frank

[57] ABSTRACT

Whereas in known needle rings the needles are of circular cross-section, the cross-section of the needles (1) the present needle ring (2) is equipped with is either oval or rectangular with flattened ends, or intermediate between these two shapes. The shorter dimension (1*a*) of the needle cross-section is to be arranged parallel to the axis of the ring. The needles (1) may be positioned perpendicularly in the ring or form an angle $\alpha$ up to 30° with the radius (2*b*), while the angle $\beta$ at the tip should lie between 15° and 45°. The needles sit in round holes (3) the diameter of which is less than the width (1*b*) of the needles which in turn is approximately 4 to 6 times the thickness of the needles. Hence, the needle does not fully occupy the volume of the hole. Two channels (3*b*) remain open, which may be used for controlling the air flow effecting the fiber transport. Needle rings of this type have as long a service life as known needle rings with needles of circular cross-section, and hence an appreciably longer service life than the combing cylinders equipped with the so-called all-steel, sets, but in contrast to known needle rollers they can be used in virtually all open-end spinning machines.

6 Claims, 1 Drawing Sheet

NEEDLE RING WITH NEEDLES FOR THE COMBING CYLINDER OF AN OPEN-END SPINNING MACHINE

TECHNICAL FIELD OF THE INVENTION AND THE STATE OF THE ART

Open-end spinning machines are equipped nowadays with essentially two types of combing cylinders, namely cylinders with all-steel sets and with cylinders with inserted needles. An all-steel set corresponds more or less to a punched and, thus, sharp-edged serrated blade inserted into slots of the cylinder.

Combing cylinders with all-steel sets possess an advantage as compared to needle cylinders that they may be used in almost all types of spinning frames, namely even if highly contaminated wool is to be spun, in contrast to the known needle cylinders which may only be used in the spinning frames of only some of the manufacturers of spinning machines. The advantage of needle cylinders resides in that they have considerably longer service lives as compared to cylinders with all-steel sets.

SUMMARY OF THE INVENTION

The novel combing cylinder with needles according to the present invention now possesses both the advantages of the cylinders with all-steel sets and the advantages of the known needle cylinders, namely, that it may be used in all types of open-end spinning machines and it has a service life at least as long as the needle cylinders known till now. It is characterized in that the needle cross-section is not circular as is known, but has either an oval shape or the shape of a rectangle having rounded corners, or else a shape intermediate these two shapes. In other words, the needles have flattened cross-sections and thus possess a lance-shaped tip. These needles are preferably so inserted in the ring as to have the shorter dimension of the needle cross-section run parallel to the ring axis. The arrangement allows the needle axes to extend radially, or to form — at the foot of the needle — an angle of up to 30° with the radius of the ring. The angle at the tip of the needle as measured in a section perpendicular to the cylinder axis preferably has a value between 15° and 45°.

Needles having flattened rather than circular cross-sections have been known for more than 20 years. As a matter of fact, the textile industry has been using — for combing fibers, i.e. for processing the fiber materials before spinning — needle strips in which such needles have been inserted. However, in the combing process the product is drawn relatively slowly through the needle strips serving as combs, whereas the needle cylinders of the open-end spinning machine known at least since 1970 rotate with at least 8000 rotations per minute, yielding a peripheral speed of the order of magnitude of 150 m/min. This significant difference in application is the reason for the fact that during 20 years, so to speak, the prejudice prevailed, that it would make no sense using needles with flattened cross-sections in needle rings of combing cylinders of open-end spinning machines. This prejudice has only been overcome after the inventors have succeeded in demonstrating the outstanding qualities of the needle rings of the invention.

BRIEF DESCRIPTION OF THE DRAWING

In the following are described embodiments of the invention by making reference to the appended drawings in which.

PREFERRED EMBODIMENTS OF THE INVENTION

Figure 1:
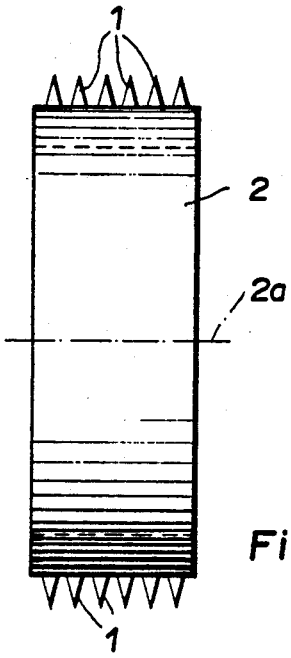
FIG. 1 a side view of a needle ring of a combing cylinder, in which only the needles disposed, so to speak, parallel to the plane of the drawing are shown, FIG. 2 the associated side view in which, however, only a single needle is shown, FIG. 3 the detail of FIG. 2 identified by III, shown on a larger scale, FIG. 4 a circular needle cross-section, which is typical of prior art needles.
Figure 2:
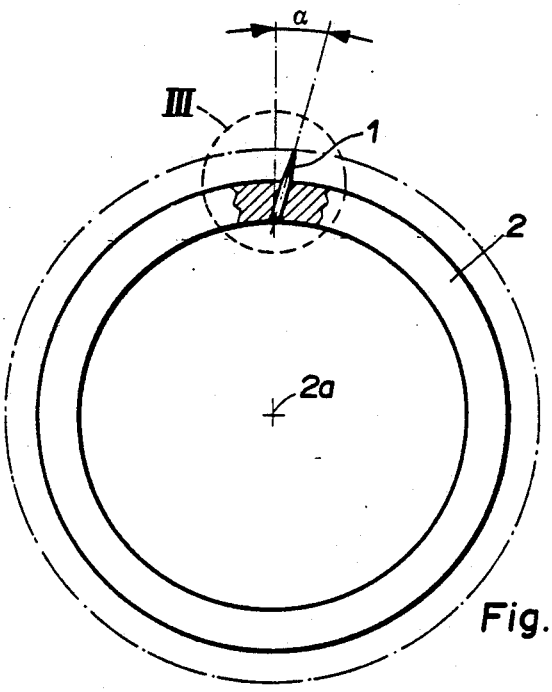
Figure 3:
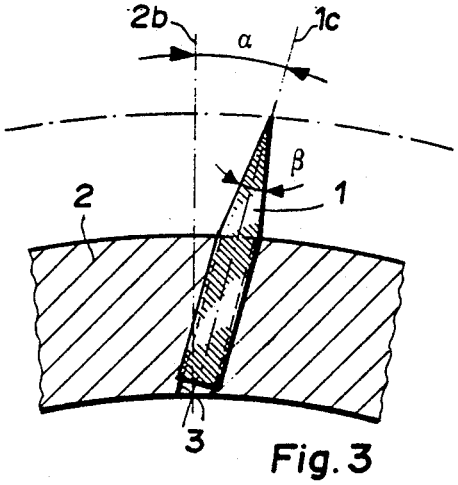
Figure 6:
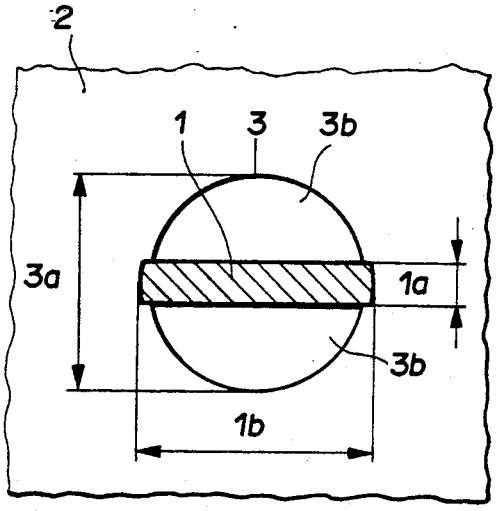

FIGS. 1, 2 and 3 illustrate the manner in which the needles 1 are inserted in the needle ring 2 which preferably consists of aluminum or brass. The ring has for example an inside diameter of 50 mm, and a wall thickness of 4 mm, while the needles 1 are 7 mm long, so that 4 mm are accommodated inside the ring and about 3 mm protrude out of the ring outer surface. Known needle rings nowadays comprise a few hundred needles, each of the needles having a circular cross-section, for example of a diameter of 0.8 mm.

Figure 4:
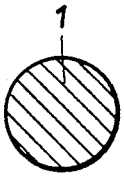
Fig. 4 PRIOR ART
Figure 5:
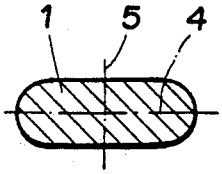
FIG. 5 a flattened needle cross-section of the present invention drawn on the same scale as in FIG. 4, and FIG. 6 a front view of the needle of the present invention inserted into the associated hole and shown on an even larger scale.

The needle cylinder according to the present invention does not comprise needles of circular cross-section as appearing in FIG. 4 of the drawing, but rather needles having flattened cross-sections. The cross-section may thus have either an oval shape or the shape of a rectangle having rounded corners, or else a shape intermediate these two shapes, while the needle tip is essentially lancet-shaped. Needles of this kind are made for example of segments of a cylindrical wire, by grinding a tip on one end of each segment, in the manner known from the manufacture of needles. Subsequently these needles are pressed flat to such a degree, that their width 1*b* resulting in the process will be about 4 to 6 times the thickness 1*a* reduced in the pressing process, i.e. the longer cross-sectional axis 4 will be about 3 times as long as the shorter cross-sectional axis 5. Then, these needles having lancet-shaped tips are so disposed inside the ring 2, that the shorter axis 5 of the needle cross-section runs parallel to the ring axis 2*a*. These needles too — like the needles with circular cross-section — have at their tips an angle $\beta$ lying between 15° and 45°. The needles 1 — per se — may sit radially inside the ring 2, or they may be inserted, as illustrated in the drawing, in the ring 2 in a way to have their axes 1*c* at the needle foot form an angle $\alpha$ of up to 30° with the radius 2*b* of the ring.

The holes in which the needles are inserted are by preference — as may be seen in the drawing — bores 3 of a diameter 3*a* somewhat smaller than the width 1*b* of the needles pressed flat, so that the needles 1 may be inserted into the bore 3 only after two slots have been punched in the wall of each bore. These slots are dimensioned so as to require the application of a certain forcer the needles 1 to be inserted in place, with the consequence that the needles 1 will fixedly and safely sit in the so deformed bores 3. When inserting the needles 1 or even before, i.e. when punching the slots, care should evidently be taken, to have the larger side of the needle extend parallel to the peripheral direction of the ring 2. As may be seen in FIG. 3, the inserted needle fills the cross-section of the bore 3 only partially, so that on both sides of each needle is left an opening 3*b*, which may be used not only for controlling the fiber transport in the spinning mechanism by means of an air current supplied to the inside of the needle ring or by means of subatmospheric pressure applied to the inside of the needle ring, but also — if desired — to remove any fine dirt by suction, continuously or intermittently. In addition to the fact, that the use of flat needles makes such control by means of air flow possible, there is an additional advantage to be achieved, namely that the needle rings with lancet-shaped needles made of cylindrical needles pressed flat are as good in regard to their combing abilities as are needle rings having serrated blades which, owing to their comparatively short service lives are of only little use. Thanks to the fact, however, that such flat needles have a structure completely different from that of serrated blades, they possess a considerably longer service life than the corresponding cylinders provided with serrated blades, and are thus suited to replace the latter even if the need for controlling the air current does not exist.

We claim:

1. A needle ring for a combing cylinder of an open-end spinning machine, comprising:

a ring having a central ring axis and a wall; and a plurality of needles secured to said wall; each said needle having a substantially oblong cross section; each said cross-section having a longer dimension and a shorter dimension substantially perpendicular to said longer dimension, said shorter dimension being oriented substantially parallel to said central ring axis.

2. A needle ring as defined in claim 1, wherein said cross section is a rectangle with rounded corners.

3. A needle ring as defined in claim 1, wherein said cross section is an oval.

4. A needle ring as defined in claim 1, wherein each said needle has a foot and a longitudinal axis, and each said needle is oriented with respect to the ring so that the longitudinal axis thereof defines an angle of up to 30 degrees at the foot of the needle with respect to said wall of said ring.

5. A needle ring as defined in claim 1, wherein each said needle has a needle tip, and at said needle tip an angle measured in a section perpendicular to said central ring axis lies between 15 and 45 degrees.

6. A needle ring as defined in claim 1, further comprising attaching means for securing the needles to said outer wall; said attaching means including a plurality of circular holes in said wall of said ring for receiving respective ones of said plurality of needles, each said circular hole having a diameter less than the longer dimension of said cross section and several times greater than the shorter dimension of said cross section.

* * * * *